US010344219B2

(12) United States Patent
Niccum et al.

(10) Patent No.: US 10,344,219 B2
(45) Date of Patent: Jul. 9, 2019

(54) CRUDE STABILIZER PROCESS

(71) Applicant: PROCESS CONSULTING SERVICES, INC, Houston, TX (US)

(72) Inventors: Grant Joseph Niccum, Houston, TX (US); Anthony Frederick Barletta, Jr., Houston, TX (US); Scott William Golden, Phillips, ME (US); Steven Leslie White, Bellaire, TX (US)

(73) Assignee: PROCESS CONSULTING SERVICES, INC., Houston, TX (US)

( * ) Notice: Subject to any disclaimer, the term of this patent is extended or adjusted under 35 U.S.C. 154(b) by 400 days.

(21) Appl. No.: 15/000,215

(22) Filed: Jan. 19, 2016

(65) Prior Publication Data

US 2017/0121610 A1 May 4, 2017

Related U.S. Application Data

(60) Provisional application No. 62/248,203, filed on Oct. 29, 2015.

(51) Int. Cl.

| | |
|---|---|
| ***C10G 7/02*** | (2006.01) |
| ***C10G 7/00*** | (2006.01) |
| ***C10G 33/06*** | (2006.01) |

(52) U.S. Cl.

CPC ..... *C10G 7/00* (2013.01); *C10G 7/02* (2013.01); *C10G 33/06* (2013.01)

(58) Field of Classification Search

CPC combination set(s) only.

See application file for complete search history.

(56) References Cited

U.S. PATENT DOCUMENTS

| | | | | | |
|---|---|---|---|---|---|
| 2,064,511 | A * | 12/1936 | Wells | B01D 27/005 | 210/186 |
| 2,970,107 | A * | 1/1961 | Gilmore | C10G 7/02 | 208/361 |
| 4,579,565 | A * | 4/1986 | Heath | E21B 43/34 | 95/15 |
| 4,960,443 | A * | 10/1990 | Lansford | B01D 19/0042 | 203/91 |
| 2013/0256093 | A1* | 10/2013 | Ishiwata | C10L 3/12 | 196/46 |
| 2014/0171705 | A1* | 6/2014 | Freet | C10G 50/00 | 585/315 |

* cited by examiner

*Primary Examiner* — Michelle Stein

(74) *Attorney, Agent, or Firm* — Patterson + Sheridan, LLP

(57) ABSTRACT

Embodiments described herein provide a method and apparatus for stabilizing a product, such as a petroleum or other hydrocarbon based product, for example crude oil. Stabilization removes volatile components from the crude such that the crude product may be safely handled, stored, and/or transported. In one embodiment, the crude stabilization system includes at least a stabilizer column and an overhead system. Effluent from the stabilizer column may be fed directly into a suction inlet of a compressor system of the overhead system. The stabilizer column is preferably operated at low pressures and temperatures, thus making a desalting system unnecessary. Furthermore, overhead trim cooling, recycle cooling, and interstage cooling may be provided by the crude feed rather than air coolers or cooling water. As such, stabilized crude product may be safely transported via any means of transportation, such as a railcar.

18 Claims, 3 Drawing Sheets

CRUDE STABILIZER PROCESS

CROSS-REFERENCE TO RELATED APPLICATIONS

This application claims benefit to U.S. Provisional Patent Application No. 62/248,203, filed Oct. 29, 2015, the entirety of which is hereby incorporated by reference.

BACKGROUND

Field

Embodiments of the present disclosure generally relate to a process and system for the stabilization of crude. More specifically, embodiments described herein relate to methods and apparatus for stabilizing crude oil components which may be hazardous during handling, storage, and/or transportation.

Description of the Related Art

A process for the stabilization of crude products generally consists of bringing crude oil at a well outlet to API standards, while substantially removing lighter hydrocarbons therefrom. Maximizing the production of crude oil which does not degas, limiting losses of light hydrocarbons, and obtaining a stabilized crude product for safe transportation is highly desired. Although bulk separation of oil, water, and gas occurs in the field, the resulting liquid often retains high quantities of light ends, resulting in a high vapor pressure or RVP. For transportation, further stabilization (e.g., to a lower vapor pressure) may be required to remove soluble light hydrocarbons from the crude.

Conventional small field stabilization units, often referred to as "heater treaters," can be used to stabilize crude for transportation, but these units are inefficient. Conventional stabilization units utilize high amounts of energy to operate and fractionate poorly, as more light material must be removed from the crude oil to meet the same vapor pressure specification. There is an incentive to minimize the amount of light material removed from the crude (i.e., minimize the shrinkage) because that material must then be sold at a discount. Minimizing shrinkage provides more stabilized crude oil available for sale at full crude price.

Conventional stabilizer columns are more efficient than field heater treaters and operate at and/or maintain crude products therein at pressures of about 150 psig, top temperatures of about 250 degrees Fahrenheit, and bottom temperatures of about 350 degrees Fahrenheit. To process crude feeds containing salts, such high temperatures require the use of a desalting system, as temperatures above about 350 degrees Fahrenheit hydrolyze feed chlorides. Hydrolyzed feed chlorides form acids that corrode equipment.

Therefore, there is a need for an improved crude stabilization system which maintains low process pressures and temperatures, reduces product shrinkage, and provides a stabilized crude product for safe transportation.

SUMMARY

Embodiments described herein provide a method and apparatus for stabilizing a product, such as a petroleum or other hydrocarbon based product, for example crude oil. Stabilization removes volatile components from the crude such that the crude product may be safely handled, stored, and/or transported. In one embodiment, the crude stabilization system includes at least a stabilizer column and an overhead system. Effluent from the stabilizer column may be fed directly into a suction inlet of a compressor system of the overhead system. The stabilizer column is preferably operated at low pressures and temperatures, thus making a desalting system unnecessary. Furthermore, overhead trim cooling, recycle cooling, and interstage cooling may be provided by the crude feed rather than air coolers or cooling water. As such, stabilized crude product may be safely transported via any means of transportation, such as a railcar.

In one embodiment, a crude stabilization system is disclosed. The crude stabilization system includes a stabilizer column and an overhead system. The stabilizer column may include a first section, a second section, a third section, and a fourth section. The second section may include at least one tray. The third section may include a plurality of trays. The fourth section may include a reboiler. The third section may be located between the second section and the fourth section. The overhead system may include a compressor. Furthermore, the first section may be directly connected to the compressor of the overhead system.

In another embodiment, a crude stabilization system is disclosed. The crude stabilization system includes a feed system, a stabilizer column, an overhead system, a reboiler system, and a stabilized crude system. The feed system may include a heating unit and a filtering unit. The stabilizer column may include a plurality of sections for processing the crude. The stabilizer column may be operatively connected with the feed system. The overhead system may include a compressor. An exit nozzle of the stabilizer column may be directly connected with a suction inlet nozzle of the compressor. The reboiler system is operatively connected to the stabilizer column and may include a heater. The stabilized crude system may include a plurality of coolers. The stabilized crude system may be operatively connected with the stabilizer column.

In yet another embodiment, a method for stabilizing crude is disclosed. The method includes transferring the crude from a storage tank into a feed system, processing the crude within the feed system, and transferring the crude from the feed system to a stabilizer column. The method may further include processing the crude through the stabilizer column, transferring a vapor of the crude from the stabilizer column directly to a compressor of an overhead system, and compressing the vapor of the crude within the overhead system at a first stage to between about 2 psig and about 80 psig. The method may also include compressing the vapor of the crude within the overhead system at a second stage to between about 100 psig and about 200 psig.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments of this disclosure and are therefore not to be considered limiting of its scope, for the disclosure may be applied to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments described herein provide a method and apparatus for stabilizing a product, such as a petroleum or other hydrocarbon based product, for example crude oil. Stabilization removes volatile components from the crude such that the crude product may be safely handled, stored, and/or transported. In one embodiment, the crude stabilization system includes at least a stabilizer column and an overhead system. Effluent from the stabilizer column may be fed directly into a suction inlet of a compressor system of the overhead system by process piping. The stabilizer column is preferably operated at low pressures and temperatures, thus making a desalting system unnecessary. Furthermore, overhead trim cooling, recycle cooling, and interstage cooling may be provided by the crude feed rather than air coolers or cooling water. As such, stabilized crude product may be safely transported via any means of transportation, such as a railcar.

Figure 1A:
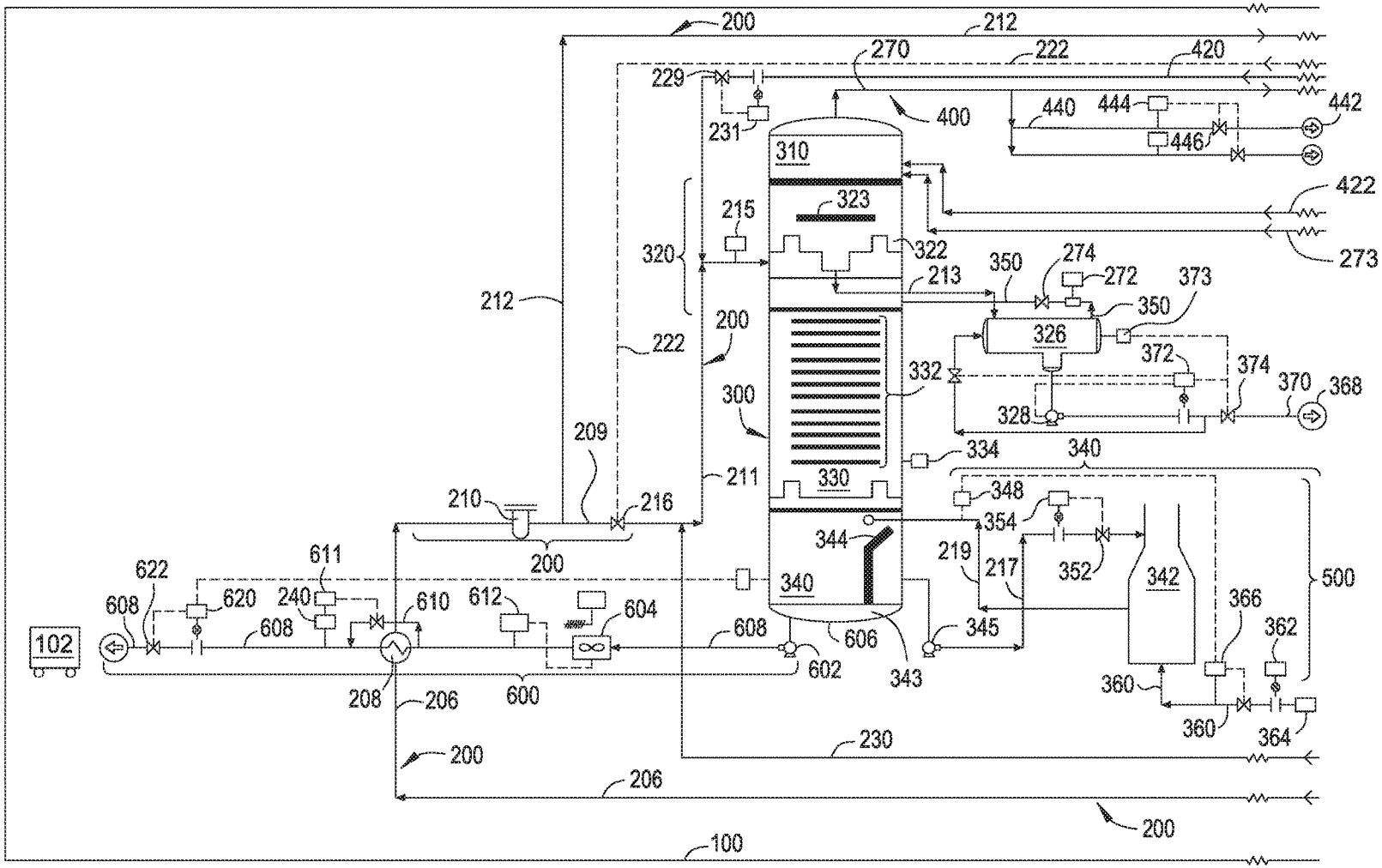
FIGS. 1A and 1B are schematics illustrating a crude stabilization system and process flows, according to one embodiment.
Figure 1B:
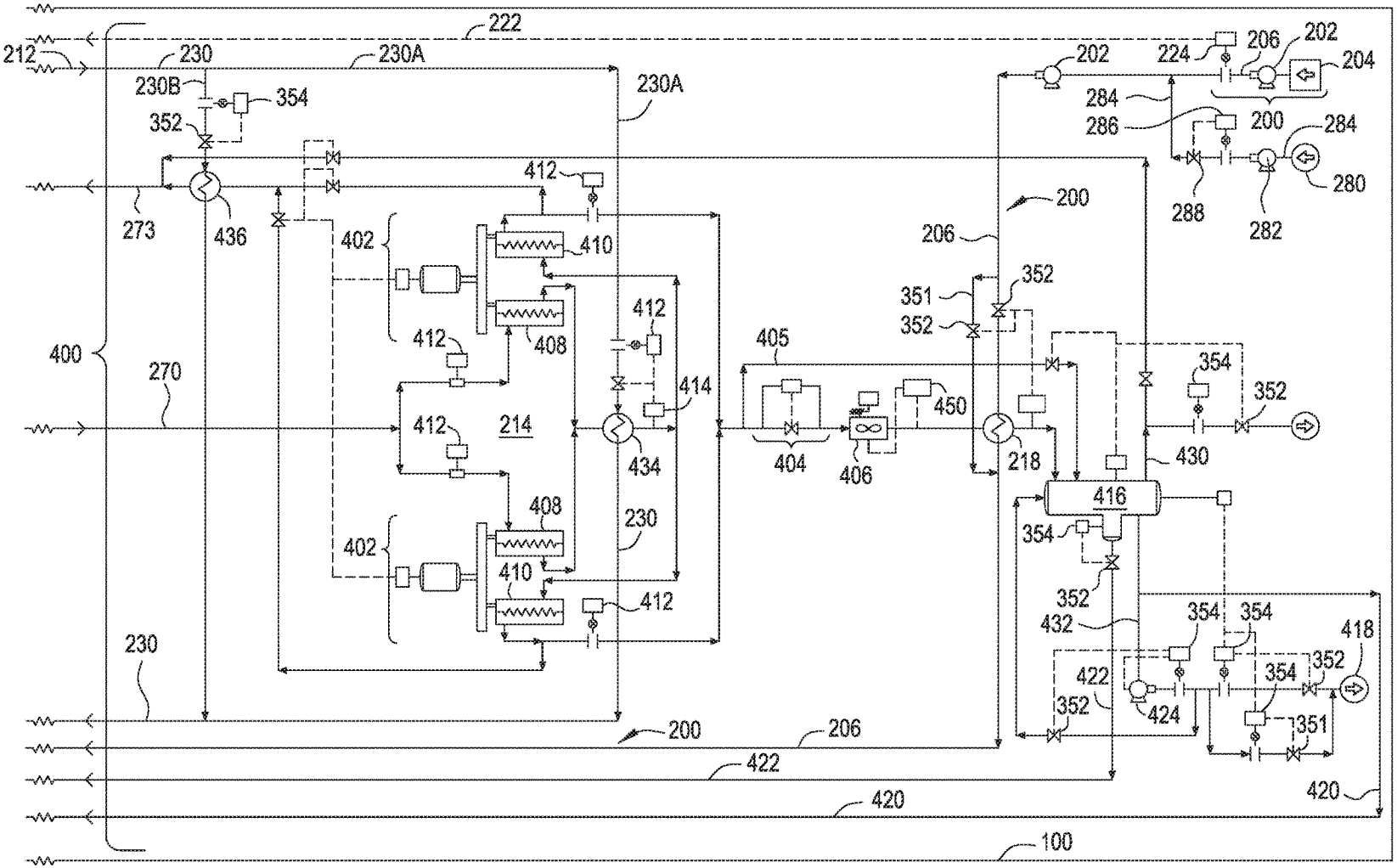

FIGS. 1A and 1B are schematics illustrating a crude stabilization system 100 and process flows for separating various components of the crude. The crude stabilization system 100 preferably includes a feed system 200, a stabilizer column 300, an overhead system 400, a reboiler system 500, and a stabilized crude product system 600. The crude stabilization system 100 may separate and/or remove volatile components from the crude. The resulting crude product may be safely handled, stored, and/or transported. Safe transport of the stabilized crude product may be provided by a pipeline, a railcar 102, or a tanker located at or near the location of the crude stabilization system 100.

The feed system 200 processes the crude by pumping the crude via a pump 202 from a storage tank 204 into the crude stabilization system 100 via supply lines 206. In some embodiments, the pump 202 may be a unit charge pump. In certain embodiments, the crude pumped by the feed system 200 may be raw, cold crude. The raw, cold crude may provide trim cooling to a tower overhead material, for example, a liquefied petroleum gas (LPG) product, via a heat exchanger 218 (See, FIG. 1B). The temperature of the LPG product may determine the amount of crude that passes through the heat exchanger 218 and the amount of crude that bypasses around the heat exchanger 218 via line 351 which may be controlled by a flow control valve 352. The raw, cold crude may also be heated via a feed-bottoms exchanger 208 of the feed system 200. In certain embodiments, the crude may be heated in a feed-bottoms exchanger. The crude may be heated to a temperature between about 70 degrees Fahrenheit and about 135 degrees Fahrenheit, for example about 90 degrees Fahrenheit. The feed-bottoms exchanger 208 may be operatively connected with a temperature controller 240 to control a temperature of the stabilized crude product 608. Heating the crude may warm the crude and reduce the viscosity of the crude.

In some embodiments, condensate feed may be pumped from a tank farm 280 by pump 282 via supply line 284. Supply line 284 may merge with supply line 206. The flow of the condensate feed may be controlled by a flow control valve 288. Flow control valve 288 may be operatively connected and/or controlled by flow controller 286.

The warmed crude may pass through a filter 210 to remove solids and/or debris therefrom. The filter 210 may prevent the accumulation of solids in the stabilizer column 300 and/or in the reboiler system 500. The filter 210 prevents the solids from passing into the stabilizer column 300 and/or the reboiler system 500. The filter 210 may remove particles larger than about 90 microns, thus preventing sediment build-up in the stabilizer column 300. Downstream of filter 210, the filtered crude may be split into a first portion, which is diverted into a slipstream line 212, and second portion which is diverted into a filtered crude line 211. A pipe 209 may be located between the filter 210 and a flow control valve 216. The slipstream line 212 may join the pipe 209 upstream of the flow control valve 216, for example between the flow control valve 216 and the filter 210. The pipe 209 may be coupled with the filtered crude line 211 and may deliver filtered crude to the filtered crude line 211. The flow control valve 216 restricts flow to divert the first portion of the filtered crude into the slipstream line 212. The flow control valve 216 may be controlled to open and/or close via a flow signal 222 from a flow controller 224. The first portion of the filtered crude may include between about five percent and about fifty percent, for example about fifteen percent, of the filtered crude. The second portion of the filtered crude may include the remainder of the filtered crude not included in the first portion of the filtered crude. In some embodiments, the slipstream line 212 may deliver the first portion of the filtered crude to a compressor area 214. In the compressor area 214, the filtered crude may provide interstage and/or recycle cooling of the compressed overhead vapor.

Compressor area 214 may compress and condense overhead from the stabilizer column 300, some of which becomes liquid LPG product stored in storage location 418, discussed infra, and some of which may be recycled back in reflux supply line 420. The second portion of the filtered crude passes through the flow control valve 216. In some embodiments, the flow control valve 216 may be a feed flow control valve. Downstream of the flow control valve 216, the first portion of the filtered crude and the second portion of the filtered crude may be rejoined and the total filtered crude feed may be transferred to the stabilizer column 300 via filtered crude line 211 which may carry filtered, warmed crude. The filtered, warm crude exits an outlet nozzle of the feed system and enters an inlet nozzle of the stabilizer column 300. The filtered crude line 211 may optionally have a temperature controller 215 operatively connected thereto for monitoring a temperature of the filtered warm crude. The slipstream line 212 may transfer filtered crude to the overhead system 400 (See, FIG. 1B) via overhead line 230. Overhead line 230 may divert a first portion of the filtered crude through the overhead system 400 via overhead line 230A such that the first portion of filtered crude is heat integrated with the compressed overhead material. Overhead line 230A may absorb heat from various compressed streams from compressor 214, described infra. Overhead line 230B may also divert filtered crude from overhead line 230 and may absorb heat from the compressor recycle line 273, and then may be recombined with filtered crude in filtered crude line 211.

Before entering the stabilizer column, an LPG reflux stream 420 may optionally mix with the filtered crude line 211. The flow of the LPG reflux stream 420 may be controlled by a flow control valve 229. Flow control valve 229 may be operatively connected and/or controlled by flow controller 231.

The stabilizer column 300 may include a first section 310, a second section 320, a third section 330, and a fourth section 340. It is contemplated that the stabilizer column may include any number of additional sections, as needed.

The stabilizer column 300 separates the filtered crude and/or removes lighter hydrocarbons from the filtered crude.

The first section 310 may be a top section located above the inlet nozzle of the stabilizer column 300 and upstream of the second section 320. The inlet nozzle may be a crude feed distributor. The first section 310 may be a compressor knockout drum. The first section 310 may be operatively connected to a compressor 402 (See FIG. 1B). The compressor 402 may compress vapor from the first section 310. In some embodiments, the first section 310 may be part of the stabilizer column 300. All vapors from the first section 310 may be charged to the suction of the compressor 402. In some embodiments, all compressor suction vapor may flow through the first section 310. Vapor from the compressor knockout drum of the first section 310 may, in some embodiments, be transferred via a vapor line 440 to a flare 442. Flow of vapor to the flare in the vapor line 440 may be controlled by a controller 444 and a control valve 446 operatively connected to the vapor line 440. Liquid from the compressor knockout drum, along with liquids condensed and recycled in the overhead system 400 (described in more detail below in connection with FIG. 1B), settle to the bottom of the first section 310 by gravity and flow to the second section 320. Gravity may force the crude and other liquids to settle out onto a chimney tray. The chimney tray may have a sump therein.

The second section 320 is located below the first section 310. The second section 320 may process the liquid of the filtered crude such that the second section 320 removes water from the liquid of the filtered crude. The second section 320 may further prevent water accumulation within the stabilizer column 300. The second section 320 may include at least one tray 323. It is contemplated, however, that the second section 320 may include any number of trays 323 for processing the filtered crude. The second section 320 may include a water draw tray. In some embodiments, the second section 320 may comprise a plurality of trays above the water draw tray. Vapor rising past the at least one tray 323 may heat filtered crude before an accumulator tray 322 to a temperature between about 100 degrees Fahrenheit and about 140 degrees Fahrenheit, for example a temperature of about 120 degrees Fahrenheit. In some embodiments, accumulator tray 322 may be a collector. The heating may be accomplished via heat transfer between a rising vapor and a falling liquid in the stabilizer column 300. The heating may warm the crude on the accumulator tray 322 to allow easier removal of water from the filtered crude on the accumulator tray 322. The water may be drawn from the accumulator tray 322 to the separator drum 326 via a water removal line 213. Hydrocarbon liquid product remaining after the water removal on the accumulator tray 322 may flow to the third section 330, for example by overflowing a weir into a downcomer.

Liquid filtered crude from accumulator tray 322 may be transferred to a separator drum 326. In some embodiments, separator drum 326 may be a horizontal separator drum. The separator drum 326 may separate water and hydrocarbon from the filtered crude. A mixed stream of water and crude may be drawn from the stabilizer column 300 to a separator drum 326. From separator drum 326, the water may be pumped out of the separator drum 326 and the excess crude (that was drawn with the water) may be returned to the stabilizer column 300. Advantages of the separator drum 326 include removing water from the crude and preventing water from descending farther down the stabilizer column 300. Furthermore, by drawing a high flow-rate in excess of the expected water rate and then separating and returning the crude back to the stabilizer column 300, any solids such as dirt, rust, and scale, may be removed and/or may settle out in the horizontal separator drum 326. Such solids may subsequently be pumped out of the separator column 300, thus preventing the fouling and plugging of trays.

The separated water may be pumped out of the crude stabilization system 100 via water line 370. Water in the water line 370 may be pumped by pump 328 to a disposal tank 368 or other suitable location. The pump 328 may be operatively connected to level controller 372. Level controller 372 may control separator drum 326. Level probe 373 may produce a level signal input to the controller 372. The controller 372 may operate control valve 374 to adjust the flow of water out of the separator drum 326 such that the interface between water and hydrocarbon is controlled in the separator drum 326, thus preventing hydrocarbon from going to water disposal tank 368. The separated hydrocarbons may be recycled to the second section 320 via recycle line 350. The flow and/or amount of separated hydrocarbons transferred by recycle line 350 may be controlled by flow control valve 274. Flow control valve 274 may be operatively connected and/or controlled by flow controller 272, which may target a flow rate for the control valve 274 based on a material balance around the separator drum 326, including total flow into the separator drum 326 and water flow out through valve 374.

Liquid from the second section 320 is transferred to the third section 330. Vapor from the second section 320 is transferred to the first section 310, as discussed supra. In some embodiments, the liquid may exit the second section 320 via an outlet nozzle and enter the third section 330 via an inlet nozzle. The third section 330 includes a plurality of trays 332. In certain embodiments, the plurality of trays 332 may include between about four trays 332 and about thirty trays 332, for example about ten trays 332. The plurality of trays 332 may receive recycled hydrocarbon from separator drum 326. At least one tray of the plurality of trays 332 may include a weir and a downcomer. In some embodiments the tray may include at least one hole for liquid to fall through and risers or chimneys for vapor to rise through to moderate pressure of the vapor. The plurality of trays 332 may strip the overhead LPG product from the bottom stabilized crude product. The plurality of trays 332 separate light hydrocarbons from heavier hydrocarbons to yield a stabilized crude product that is ultimately withdrawn as tower bottoms and an LPG product that is ultimately recovered from tower overhead system. Heat and mass is transferred between the descending liquid material and rising vapor generated by the reboiler system 500. In some embodiments, the third section 330 may include a temperature controller 334 for controlling a temperature of the third section 330. Liquids are transferred from the third section 330 to the fourth section 340 by, for example, weir and downcomer, holes, seal pans, and or risers.

The fourth section 340 may be below the third section 330. As such, liquid from the third section 330 may be transferred from the third section 330 to the fourth section 340. In some embodiments, the crude may exit the third section 330 via an outlet nozzle and enter the fourth section 340 via an inlet nozzle. The fourth section 340 may include a reboiler system 500. The reboiler system 500 may include a reboiler 342. In some embodiments, the reboiler 342 may be a heater. In certain embodiments, the heater of the reboiler system 500 may be a direct-fired heater or hot oil system. In some embodiments the reboiler 342 may be a furnace reboiler. The tower bottoms liquid may be pumped through heater 342. The stabilizer column 300 is reboiled by the heater 342, and specifically the crude containing heavy hydrocarbons is reboiled by the heater 342. A liquid rate may be set such that a temperature of a film (not shown) in the heater 342 remains lower than about 400 degrees Fahrenheit, for example a temperature lower than about 350 degrees Fahrenheit. Maintaining the film temperature in the heater 342 below about 350 degrees Fahrenheit may prevent hydrolysis of chlorides in the bottoms of the stabilizer column 300. Heating of the crude to a temperature greater than about 350 degrees Fahrenheit, for example about 380 degrees Fahrenheit, may cause corrosion, which is conventionally prevented by using a desalting system. Operating at the reduced temperatures described herein reduces liberation of chlorides, and the resulting corrosion, so that a desalting system is not needed. Fuel gas may be supplied to the reboiler 342 from a fuel gas storage tank 364, or pipeline, to the reboiler 342 via fuel gas line 360. Fuel gas line 360 may be operatively connected to flow controller 362 for controlling the amount of fuel gas supplied to the reboiler 342. The fuel gas line 360 may further be operatively connected to a process controller 366. The process controller 366 may communicate with temperature controller 348 in order to regulate the amount of fuel gas supplied to the reboiler 342 such as to regulate the temperature of the reboiler. A partial baffle 344 may force and/or direct the filtered crude into a flow pattern. The flow pattern around partial baffle 344 may direct the filtered crude to pass a bottom head 343 of the stabilizer column 300 and flow upward to a reboiler draw nozzle. The flow pattern may function to remove sediment and/or other unwanted materials out of the bottom head 343 rather than pumping it to the reboiler system 500. In certain embodiments, the bottom head 343 may be a sump. The fourth section 340 may further include a temperature control 348 for measuring and maintaining a temperature of the reboiler return, a plurality of flow control valves 352, and a plurality of flow controllers 354. Crude processed in the fourth section 340 may be pumped to the reboiler 342 in reboiler line 217 via pump 345. Reboiled crude may be returned to the fourth section 340 via reboiler return line 219.

The crude stabilization system 100 may further include an overhead system 400. Vapor exits an outlet nozzle of the stabilizer column 300 and enters an inlet nozzle of the overhead system 400. Vapor may exit the stabilizer column via overhead vapor line 270. The outlet nozzle of the stabilizer column 300 may be connected with the inlet nozzle of the overhead system 400, such that the outlet nozzle of the stabilizer column 300 may be fed into the overhead system 400. The overhead system 400 may include a compressor 402. The overhead system 400 may further comprise a plurality of flow indicators 412 for measuring flow of the vapor of the crude through the overhead system 400, and/or a plurality of temperature controllers 414 for monitoring or regulating temperature of the vapor of the crude. In certain embodiments, the compressor 402 may be a two-stage compressor. In certain embodiments the compressor 402 may be a two-stage dry screw compressor. It is contemplated that the compressor 402 may be any suitable compressor, such as a one-stage compressor, etc. The outlet nozzle of the stabilizer column 300 may be directly connected into an inlet of the compressor 402 by piping and/or valves, without intervening equipment or other unit operations. As such, the vapor from the stabilizer column overhead may be directly fed into the suction of the compressor 402. The vapor from the stabilizer column may be split between one or more compressors 402. A first stage 408 of the compressor 402 may compress the vapor to a pressure of between about 2 psig and about 80 psig, for example between about 5 psig and about 50 psig. Subsequent to the compressing of the vapor product at the first stage 408 of the compressor 402, interstage cooling is performed in a heat exchanger 434, such as a shell and tube exchanger. The interstage temperature may be controlled above the vapor dew point. Subsequent to the interstage cooling, the vapor product may enter the second stage 410 of the compressor 402. Any condensibles may be separated in a knockout drum (not shown) prior to the second stage 410 and recycled to the first section 310 of the stabilizer column 300. In between the first stage 408 and the second stage 410 of the compressor 402, interstage temperature is controlled to a temperature above the crude vapor dew point to avoid feeding large quantities of liquid to the second stage of the compressor 402.

The second stage 410 of the compressor 402 may compress the vapor of the crude to a pressure of between about 100 psig and about 200 psig, for example about 150 psig. The vapor may exit the second stage 410 of the compressor 402 at a pressure of about 150 psig. The vapor may be condensed, via condensers 406, 218, into a liquid LPG product, a vent gas product, and a water product. Condensers 406, 218 may liquefy overhead from the stabilizer column 300, some of which becomes liquid LPG product stored in storage location 418, discussed infra, and some of which is recycled back in reflux supply line 420. Each of the LPG product, the vent gas product, and the water product may be recovered in a high pressure receiver 416. The vent gas may be carried by vent gas line 430. Condensation may be performed using an air cooler 406. It is contemplated, however, that although an air cooler 406 is disclosed, other coolers may be utilized within the embodiments disclosed. The air cooler 406 may be operatively connected to a temperature controller 450 for regulating and/or monitoring a condensation rate of the air cooler 406 by regulating and adjusting heat duty of the air cooler 406. Trim cooling may be provided by raw, cold crude, discussed supra with reference to the feed system 200. As such, trim cooling may be provided at heat exchanger 218. Two pressure control valves may regulate the pressure in the high pressure receiver 416. A differential pressure controller 404 may be upstream of air cooler 406. The differential pressure controller 404 may create a pressure drop in the main stream to force vapor through a hot vapor bypass 405. The pressure in the high pressure receiver 416 may be raised by opening the hot vapor bypass 405. The pressure in the high pressure receiver 416 may be lowered by venting vapor to the fuel gas system.

If it is determined that compressor recycle of the vapor product is needed, the recycle vapor product may be cooled against crude in a heat exchanger 436, such as shell and tube exchanger. Recycled vapor may be provided back to the stabilizer column 300 via compressor recycle line 273.

Liquid LPG product may be pumped to a storage location 418 via a pump 424 in LPG supply line 432. In the event a vent gas is produced from the high pressure receiver 416, the gas may be mixed into the fuel gas system and subsequently burned. Water may be returned to the stabilizer column 300 via water return supply line 422. The stabilizer column 300 may capture the water in a horizontal water separator and combine the water with the feed water. In some embodiments, the flow and/or amount of water transferred by water return supply line 422 may be controlled by a flow control valve (not shown). In certain embodiments, the flow control valve may be operatively connected and/or controlled by a flow controller (not shown).

The crude stabilization system 100 may further include a stabilized crude system 600. Stabilized crude may be pumped, via pump 602, in a cooled product stream 608 from a bottom head 606 of the stabilizer column 300 through a plurality of coolers 604. In some embodiments, the plurality of coolers 604 may be a plurality of air coolers. The plurality of coolers 604 may reduce a temperature of the stabilized crude from about 160 degrees Fahrenheit to a temperature of less than about 140 degrees Fahrenheit, for example a temperature of about 120 degrees Fahrenheit. The temperature of the stabilized crude may be controlled and/or monitored by a temperature controller 612 operatively connected to the plurality of coolers 604. Subsequently, the stabilized crude may be transferred to the feed-bottoms exchanger 208. Within the feed-bottoms exchanger 208 raw, cold crude in supply line 206 cools the stabilized crude in cooled product stream 608 to a temperature of less than about 110 degrees Fahrenheit, for example a temperature of about 100 degrees Fahrenheit. In some embodiments, the cooled product stream line 608 may be operatively connected with a bypass line 610. Bypass line 610 may bypass the feed-bottoms exchanger 208. In some embodiments, the cooled product stream line 608 and/or the feed-bottoms exchanger 208 may be operatively connected to a bypass control valve 611. The bypass control valve 611 may control the stabilizer feed temperature to minimize overhead product. After cooling, the stabilized crude may be transferred, via cooled product stream 608, to a storage location (not shown) or may be loaded into a transport vehicle, such as a railcar 102. The flow of the stabilized crude may be controlled by a flow controller 620 and a flow control valve 622.

Figure 2:
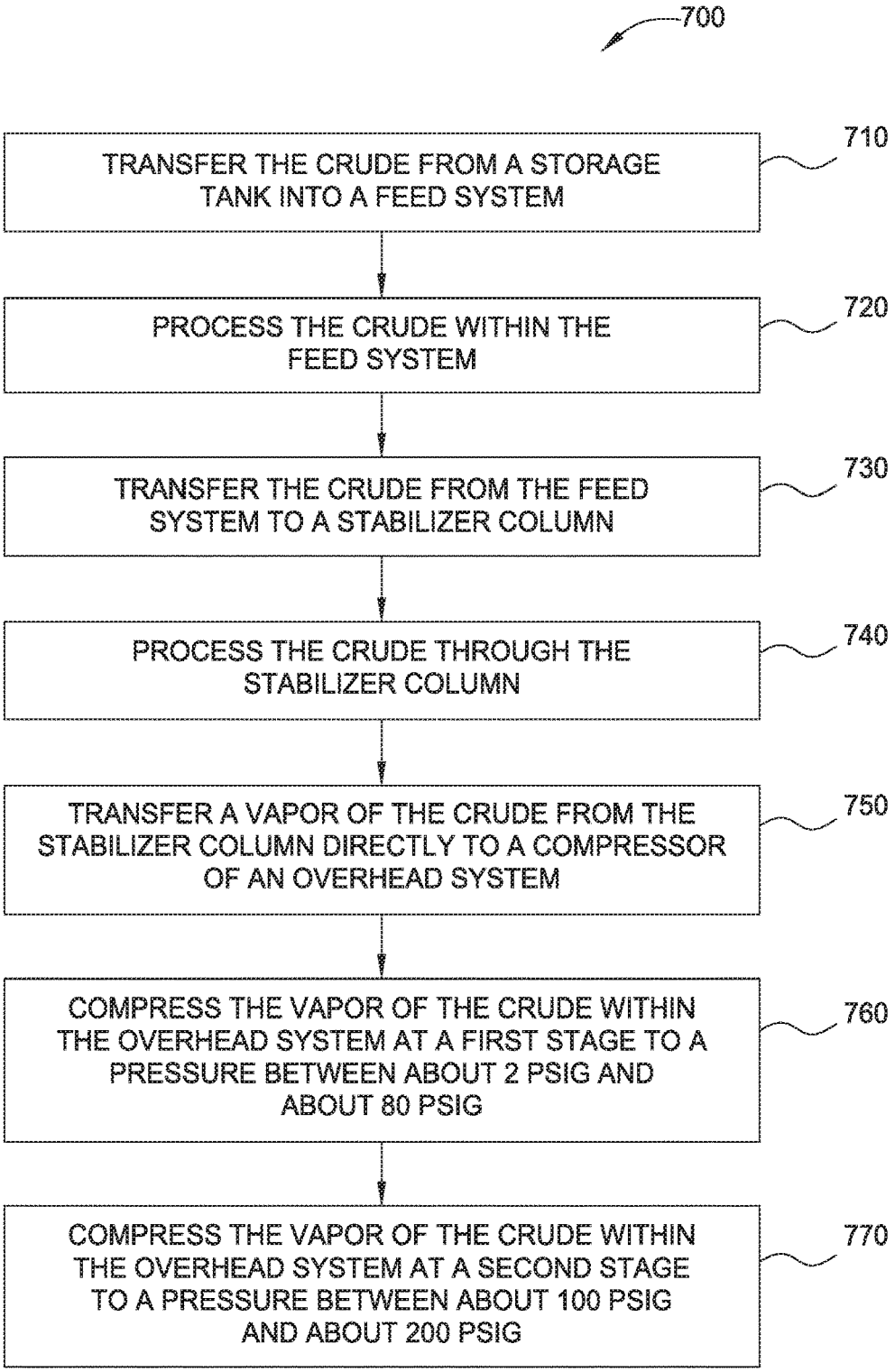
FIG. 2 is a flow diagram illustrating operations of a method for stabilizing crude, according to one embodiment.

FIG. 2 schematically illustrates operations of a method 700 for making a stabilized crude product from a raw crude material according to one embodiment described herein. In certain embodiments, the material may be a crude oil. At operation 710, the material may be transferred from a storage tank into a feed system. At operation 720 the material may be processed within the feed system. The processing of the material within the feed system may include heating the material to a temperature between about 70 degrees Fahrenheit and about 110 degrees Fahrenheit, for example a temperature of about 90 degrees Fahrenheit. The processing of the material within the feed system may further include filtering the material. The processing of the material within the feed system may also include diverting a first portion of the material to a compressor area and a second portion of the material to a flow control valve. The compressor area may accept interstage and recycle cooling from the material and preheat the feed to achieve heat recovery. The processing of the material within the feed system may also include rejoining the first portion of the material and the second portion of the material.

At operation 730 the material may be transferred from the feed system to a stabilizer column. At operation 740 the material may be processed through the stabilizer column. The processing of the material through the stabilizer column may include processing the material through a stabilizer column with a first section, a second section, a third section, and a fourth section. The first section of the stabilizer column may function as a compressor knockout drum. The second section of the stabilizer may remove water from the material and/or heat the material. The second section of the stabilizer column may heat the material to a temperature between about 100 degrees Fahrenheit and about 140 degrees Fahrenheit, for example a temperature of about 120 degrees Fahrenheit. Additionally, in some embodiments, the second section may separate water from the hydrocarbon, remove the water from the stabilizer column, and return to the stabilizer column any hydrocarbon drawn with the water stream. The third section of the stabilizer column may strip LPG products from the material. The fourth section of the stabilizer column may reboil the material.

At operation 750 a vapor of the material may be transferred from the stabilizer column directly to a compressor of an overhead system. The transferring may include transferring the vapor of the material directly to a suction inlet nozzle of the compressor. In some embodiments, an exit nozzle of the stabilizer column may be directly connected with a suction inlet nozzle of the compressor by process piping and/or valves, without intervening equipment or other unit operations. At operation 760 the vapor of the material may be compressed within the overhead system at a first stage to between about 2 psig and about 80 psig. At operation 770 the vapor of the material may be compressed within the overhead system at a second stage to a pressure between about 100 psig and about 200 psig. The compressing may include using a two-stage dry screw compressor to increase the pressure of the vapor of the material. In some embodiments, the vapor of the material may be cooled within a first section of the overhead system after the compressing of the vapor of the material within the overhead system at the first stage, and/or condensed within a second section of the overhead system after compressing the vapor of the material within the overhead system at the second stage. The interstage cooling may control a temperature of the vapor of the material above a vapor dew point of the vapor material. The condensing may be provided by an air cooler. The condensing may separate the vapor of the material into a liquid LPG product, a vent gas, and water. The LPG product, the vent gas, and the water may be separated into a high pressure receiver.

Throughout the method 700 for making a stabilized crude product, the temperature of the material is maintained at a temperature below about 350 degrees Fahrenheit. Maintaining the temperature of the material below about 350 degrees Fahrenheit may prevent hydrolysis of feed chlorides. Heating the material to a temperature above about 350 degrees Fahrenheit may cause extensive corrosion unless a desalting system is included upstream of the stabilization column. The method 700 avoids the requirement of a desalting system.

In some embodiments, the method 700 for stabilizing the material may further include reboiling the stabilizer column with a fired heater, wherein a liquid rate is set such that a temperature of the fired heater is maintained below about 350 degrees Fahrenheit.

In some embodiments, the method 700 for stabilizing the material may further include pumping the material from the stabilizer column to a plurality of coolers, wherein the plurality of coolers reduce the temperature of the material to a temperature of less than about 140 degrees Fahrenheit, for example about 120 degrees Fahrenheit.

In some embodiments, the method 700 for stabilizing the material may further include transferring the material to a feed bottoms exchanger, wherein the feed bottoms exchanger cools the material to a temperature of less than about 110 degrees Fahrenheit, for example about 100 degrees Fahrenheit.

In some embodiments, the method 700 for stabilizing the material may further include transferring the material into a storage tank and/or a transport tank, such as a railcar.

The crude stabilization system 100 described herein provides for a low Reid vapor pressure (RVP), thus allowing for materials, such as crude, to be produced more efficiently and at lower costs. RVP is a measure of the volatility of the material, such as the crude product. RVP is defined herein as the absolute vapor pressure exerted by a liquid at 100 degrees Fahrenheit as determined by the test method ASTM-D-323. The test method applies to volatile crude oil and volatile nonviscous petroleum liquids. Specifically, the processed crude described herein may have a RVP suitable for safely transporting the crude by railcar.

Benefits of the disclosure include a stabilizer column that operates and maintains the crude at a low pressure and a low temperature. To illustrate, the stabilizer column described herein may operate and/or maintain crude therein at a pressure of about 5 psig, as described supra. By way of further example, the stabilizer column described herein may operate and/or maintain crude therein at a top temperature of about 90 degrees Fahrenheit and a bottom temperature of about 160 degrees Fahrenheit. Further benefits include a stabilizer column overhead which feeds material coming off of the stabilizer column overhead directly into the overhead system, and the inlet of the overhead system is the suction of the two-stage dry screw compressor. Additional benefits may include overhead trim cooling, recycle cooling, and interstage cooling provided by the feed system rather than by air coolers or cooling water.

Low process pressures allow for lower equipment design pressures, thus reducing production costs, maintenance costs, and/or operational costs. As such, piping of the 150 pound class, for example, may be utilized throughout the entire crude stabilization system upstream of the compressor. Low process temperatures allow for lower design temperatures, thus reducing production costs, maintenance costs, and/or operational costs. Low process temperatures may further allow for crude products with significant salt levels, for example Bakken, to be processed within the crude stabilization system disclosed without the use of a desalter. Reductions in the amount and types of equipment required may further reduce production costs, maintenance costs, and/or operational costs. A low bottoms temperature reduces the use and operation of the fired heater, and provides for a reduction in the area required in the feed-bottoms exchanger service.

The apparatus described herein can be built at lower cost than conventional high pressure crude stabilization systems because the parts list for the apparatus is minimized. Additionally, design pressures are lower, further reducing production and operational costs. Operation at low pressure enables processing at lower heat and cooling loads, resulting in lower operating expense than conventional systems. Lowering the consumption of fuel gas and/or eliminating the need for cooling water reduces costs and reduces the overall footprint of the crude stabilization system. Moreover, the present disclosure results in lower crude shrinkage, since a higher volume of crude feed is recovered compared to conventional crude stabilization systems.

It will be appreciated to those skilled in the art that the preceding examples are not limiting. It is intended that all permutations, enhancements, equivalents, and improvements thereto that are apparent to those skilled in the art upon a reading of the specification and a study of the drawings are included within the true spirit and scope of the present disclosure. It is therefore intended that the following appended claims include all such modifications, permutations, and equivalents as fall within the true spirit and scope of these teachings.

What is claimed is:

1. A method for stabilizing crude, comprising:

transferring the crude from a storage tank into a feed system;

processing the crude within the feed system;

transferring the crude from the feed system to a stabilizer column;

processing the crude through the stabilizer column;

transferring a vapor of the crude from the stabilizer column directly to a compressor of an overhead system;

compressing the vapor of the crude within the overhead system at a first stage to a pressure between about 2 psig and about 80 psig; and compressing the vapor of the crude within the overhead system at a second stage to a pressure between about 100 psig and about 200 psig, wherein processing the crude within the feed system comprises:

heating the crude to a temperature between about 70 degrees Fahrenheit and about 135 degrees Fahrenheit;

filtering the heated crude;

diverting a first portion of the filtered and heated crude to a first and second heat exchanger and a second portion of the filtered and heated crude to the stabilizer column, the first portion providing interstage cooling of the compressed vapor in the first heat exchanger between a first and second stage of the compressor of the overhead system and cooling of the compressed vapor at the second heat exchanger which is recycled to the stabilizer column; and rejoining the first portion of the filtered and heated crude from the first and second heat exchangers with the second portion of the crude upstream of the stabilizer column.

2. The method of claim 1, wherein the processing of the crude within the stabilizer column comprises:

separating the vapor from the crude in the stabilizer column;

processing the vapor of the crude through a first section of the stabilizer column, wherein the first section of the stabilizer column comprises a compressor knockout drum;

processing the crude through a second section of the stabilizer column, wherein the second section removes water from the crude;

processing the crude through a third section of the stabilizer column, wherein the third section separates LPG products from the crude; and processing the crude through a fourth section of the stabilizer column, wherein the fourth section reboils the crude.

3. The method of claim 2, wherein the second section heats the crude to a temperature between about 100 degrees Fahrenheit and about 140 degrees Fahrenheit.

4. The method of claim 2, wherein the second section further draws the water and the crude to a separator drum, wherein the separator drum removes the water from the crude and reintroduces the crude to the stabilizer column.

5. The method of claim 2, wherein the first section is connected to the second section, the second section is connected to the third section, and the third section is connected to the fourth section.

6. The method of claim 1, wherein compressing comprises using a two-stage dry screw compressor to increase the pressure of the vapor of the crude.

7. The method of claim 6, wherein transferring the vapor from the stabilizer column directly to the compressor of the overhead system further comprises transferring the vapor of the crude directly to a suction inlet of the two-stage dry screw compressor.

8. The method of claim 1, further comprising:

cooling the vapor of the crude within a first section of the overheard system after the compressing of the vapor of the crude within the overhead system at the first stage; and condensing the vapor of the crude within a second section of the overhead system after compressing of the vapor of the crude within the overhead system at the second stage.

9. The method of claim 8, wherein the cooling controls a temperature of the vapor of the crude above a vapor dew point of the vapor of the crude.

10. The method of claim 8, wherein the vapor of the crude is condensed to form a liquid LPG product, a vent gas, and water.

11. The method of claim 10, wherein the LPG product, the vent gas, and the water are separated in a high pressure receiver.

12. The method of claim 8, wherein the condensing is provided by an air cooler.

13. The method of claim 1, further comprising reboiling a first area of the stabilizer column with a fired heater, wherein a liquid rate is set such that an outlet temperature of the fired heater is maintained between about 250 degrees Fahrenheit and about 350 degrees Fahrenheit.

14. The method of claim 13, further comprising pumping the crude from the stabilizer column to a plurality of coolers, wherein the plurality of coolers reduce the temperature of the crude to a temperature of less than about 140 degrees Fahrenheit.

15. The method of claim 14, further comprising transferring the crude to a feed bottoms exchanger, wherein the feed bottoms exchanger trim cools the crude to a temperature of less than about 110 degrees Fahrenheit.

16. The method of claim 15, further comprising transferring the crude from the feed bottoms exchanger to a rail car.

17. The method of claim 1, wherein a temperature of the crude is maintained below about 350 degrees Fahrenheit throughout the method.

18. The method of claim 8, wherein the condensing is provided by a heat exchange with the crude before processing the crude in the feed system.

* * * * *